US011393620B2

(12) United States Patent
Bosch

(10) Patent No.: US 11,393,620 B2
(45) Date of Patent: Jul. 19, 2022

(54) TRANSFORMER APPARATUS AND METHOD FOR MANUFACTURING IT

(71) Applicant: ZF Friedrichshafen AG, Friedrichshafen (DE)

(72) Inventor: Thomas Bosch, Ravensburg (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 747 days.

(21) Appl. No.: 16/310,604

(22) PCT Filed: May 16, 2017

(86) PCT No.: PCT/EP2017/061703
§ 371 (c)(1),
(2) Date: Dec. 17, 2018

(87) PCT Pub. No.: WO2017/220255
PCT Pub. Date: Dec. 28, 2017

(65) Prior Publication Data

US 2019/0180921 A1 Jun. 13, 2019

(30) Foreign Application Priority Data

Jun. 22, 2016 (DE) ..... 102016211085.3

(51) Int. Cl.
*H01F 27/32* (2006.01)
*H01F 27/28* (2006.01)
(Continued)

(52) U.S. Cl.
CPC ..... *H01F 27/2823* (2013.01); *H01F 27/08* (2013.01); *H01F 27/24* (2013.01);
(Continued)

(58) Field of Classification Search
CPC ..... H01F 27/2823; H01F 27/08; H01F 27/24; H01F 27/2804; H01F 27/323; H01F 41/122; H01F 2027/2809; H01F 2027/2814
See application file for complete search history.

(56) References Cited

U.S. PATENT DOCUMENTS 5,175,525 A * 12/1992 Smith ..... H01F 27/2866 336/183
5,949,191 A * 9/1999 Cassese ..... H05B 41/288 315/82
(Continued)

FOREIGN PATENT DOCUMENTS

WO WO 92/22917 12/1992
WO WO 01/78091 A1 10/2001
WO WO 2005/122193 A1 12/2005

OTHER PUBLICATIONS

German Search Report and Office Action dated May 4, 2017 for German Patent Application No. 10 2016 211 085.3, 12 pgs.
(Continued)

*Primary Examiner* — Tuyen T Nguyen
(74) *Attorney, Agent, or Firm* — Crowell & Moring LLP

(57) ABSTRACT

A transformer apparatus (200) comprising a transformer core (210), at least one primary winding and at least one secondary winding. The transformer apparatus (200) also comprises an insert element (220), in which the at least one primary winding is arranged, and one printed circuit board (230), in which the at least one secondary winding is arranged. The insert element (220), the circuit board (230) and the transformer core (210) can hereby be coupled together or are coupled together.

11 Claims, 5 Drawing Sheets

Figure 1:
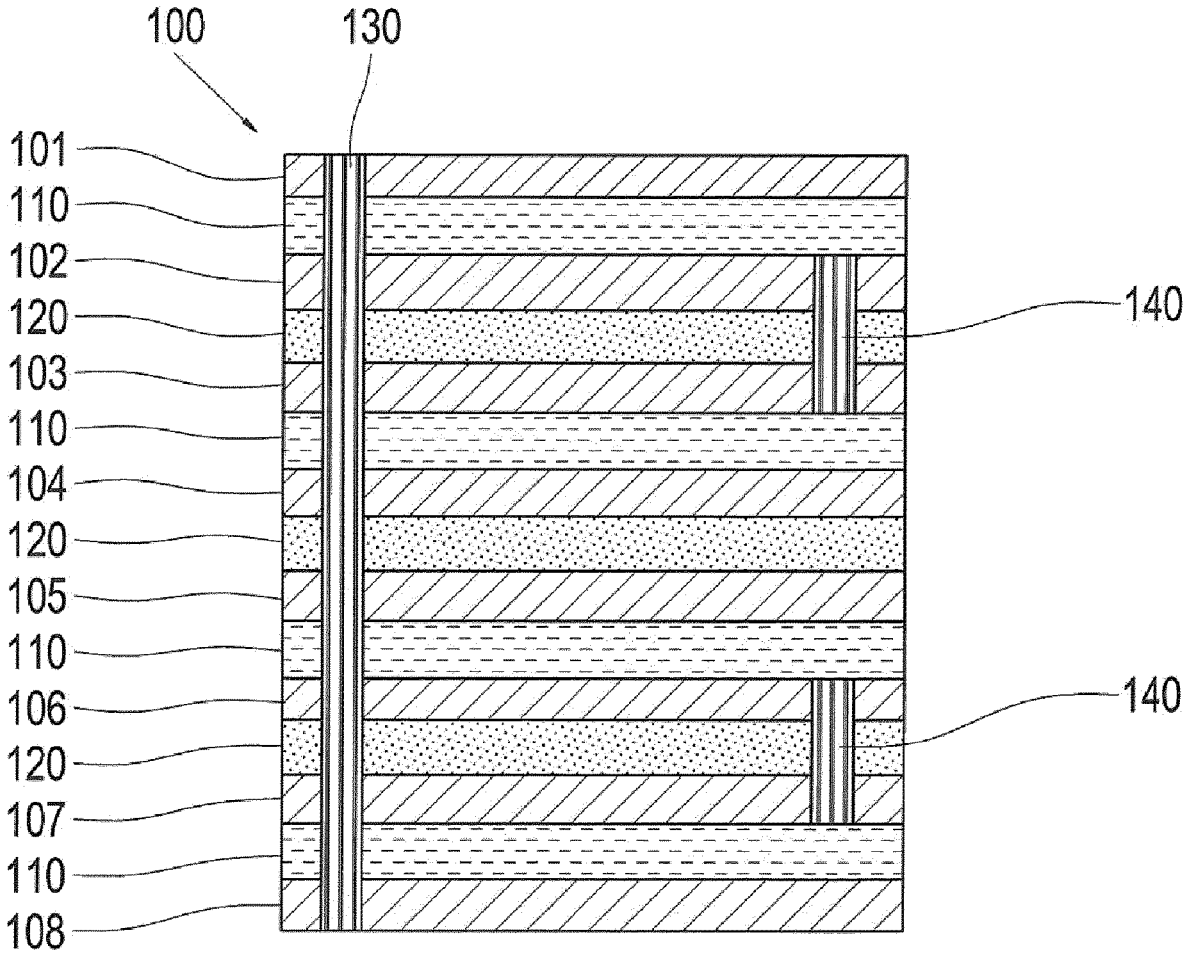

(51) Int. Cl.
*H01F 27/08* (2006.01)
*H01F 27/24* (2006.01)
*H01F 41/12* (2006.01)

(52) U.S. Cl.
CPC ..... *H01F 27/2804* (2013.01); *H01F 27/323* (2013.01); *H01F 41/122* (2013.01); *H01F 2027/2809* (2013.01); *H01F 2027/2814* (2013.01)

(56) References Cited

U.S. PATENT DOCUMENTS

| | | | | |
|---|---|---|---|---|
| 6,522,233 | B1 * | 2/2003 | Kyoso | H01F 27/306 336/192 |
| 8,164,408 | B2 * | 4/2012 | Kim | H01F 27/306 336/200 |
| 2002/0075120 | A1 | 6/2002 | Yeh et al. | |
| 2010/0301981 | A1 | 12/2010 | Zeng et al. | |
| 2012/0315792 | A1 | 12/2012 | Costello | |
| 2015/0061805 | A1 | 3/2015 | Eom et al. | |
| 2015/0228398 | A1 | 8/2015 | Moiseev et al. | |
| 2016/0078996 | A1 | 3/2016 | Li et al. | |

OTHER PUBLICATIONS

International Search Report and Written Opinion of the International Search Authority in International PCT Application No. EP2017/061703 (German language), 29 pgs.

* cited by examiner

TRANSFORMER APPARATUS AND METHOD FOR MANUFACTURING IT

RELATED APPLICATIONS

This application claims the benefit under 35 U.S.C. § 371 of the filing date of International Patent Application No. PCT/EP2017/061703, having an international filing date of May 16, 2017, which claims priority to German Application No. 10 2016 211 085.3, filed Jun. 22, 2016, the contents of both of which are incorporated herein by reference in their entirety.

The present invention relates to a transformer apparatus, to a method for manufacturing a transformer apparatus, to a corresponding apparatus and to a corresponding computer program product.

Transformers with galvanic isolation can be manufactured e.g. with copper wire windings around a ferrite core on the primary and on the secondary side. Another possibility to accomplish this would be e.g. by means of planar transformers, whose windings can be implemented within a printed circuit board.

In this context, the present invention provides an improved transformer apparatus, an improved method for manufacturing a transformer apparatus, an improved apparatus as well as an improved computer program product in accordance with the main claims. Advantageous embodiments can be derived from the sub-claims and from the following description.

According to embodiments of the present invention, it is particularly possible to provide a combination of a press-fit element with a primary winding and a circuit-board-based planar transformer with a secondary winding and to thereby implement a hybrid transformer or a hybrid planar transformer. In this way it is possible to e.g. combine the advantages of conventionally wound transformers with the advantages of planar transformers. It is thus possible to arrange in particular primary windings and secondary winding in structurally separate units which are coupled to each other, wherein at least one of these can be configured as a circuit board.

When compared to a transformer that is completely made in a planar configuration, it is advantageously possible to reduce the complexity of a circuit board configuration due to the combination particularly in accordance with the embodiments of the present invention. Furthermore, by eliminating e.g. the primary winding in the circuit board, it is possible to omit among other things the buried through-hole platings or the so-called buried vias within the circuit board and thus to simplify the configuration of the circuit board. In addition to this, it is also possible to particularly implement creepages and clearances by means of the insert element that is made of e.g. plastic material and these do not need not be considered within the circuit board. Depending on a ratio of the number of the windings, it is also possible to achieve a reduction of the amount of layers of the printed circuit board or of the amount of layers within the printed circuit board, for example by at least 2 or 4 layers, depending on the ratio of the number of the windings of only e.g. 5:1:1 or 16:1:1. It is particularly possible to increase a degree of the copper filling of an available winding window in the transformer core.

Compared to conventionally wound transformers, it is e.g. possible to improve among other things a cooling or heat dissipation, to simplify the manufacturing, to implement creepages and clearances in a simplified way, to implement an electrical contacting in a different manner than by means of screw connections or solder joints, to simplify the configuration and connection techniques for high power applications and to reduce a leakage inductance.

When compared to planar transformers that are configured in a single circuit board, it is possible to particularly reduce the number of layers of the printed circuit board in order to utilize the winding window. Furthermore, primary windings for example, onto which high voltage potential may be supplied, only need to fulfill reduced requirements for creepages and clearances or isolation distances.

A transformer apparatus is presented, wherein the transformer apparatus comprises a transformer core, at least one primary winding and at least one secondary winding, wherein the transformer apparatus features an insert element, in which the at least one primary winding is arranged, and a printed circuit board, in which the at least one secondary winding is arranged, wherein the insert element, the circuit board and the transformer core can be coupled to each other or are coupled to each other.

The transformer apparatus may be implemented as a transformer apparatus with galvanic isolation. The transformer core may be implemented as a ferrite core or as an iron core. It can be arranged that the insert element can be mechanically and optionally in addition to this also electrically coupled to the circuit board or that they are coupled to each other.

According to one embodiment, the insert element may comprise at least one stranded wire and an electrically insulating material. In this case, the at least one stranded wire may be embedded into the electrically insulating material. The electrically insulating material may comprise a plastic material. The at least one stranded wire may be a high-frequency stranded wire. Such an embodiment provides the advantage that, particularly due to a primary winding on the basis of a high-frequency stranded wire, it is possible to achieve a reduction of primary passage losses by means of an increased overall wire cross-section. Creepages and clearances can also be implemented in a simple manner by means of an embedding into a plastic carrier.

Alternatively, the insert element may comprise a further circuit board, into which the at least one primary winding can be arranged. Such an embodiment offers the advantage that, with a reduced current load at the at least one primary winding, the insert element can also be implemented in form of a further or additional circuit board as an insert element. The number of layers of the two circuit boards can also be reduced by means of this embodiment variant.

The insert element can furthermore feature at least one press-fit element that is to be pressed into the printed circuit board in order to couple the insert element with the printed circuit board. The at least one press-fit element can be formed e.g. from a metallic material. Such an embodiment provides the advantage that the insert element, which is e.g. designed as a plastic carrier with the at least one primary winding, and the circuit board can be connected to each other in an easy, quick and reliable manner by means of a press-fitting technique.

To accomplish this, the insert element may feature a plurality of press-fit elements. Two press-fit elements of the plurality of press-fit elements may therefore be formed as electrical connections for the primary winding. Thus, two press-fit elements can be electrically connected to the primary winding and can be electrically contacted by means of a press-fitting into the circuit board. Such an embodiment presents the advantage that space and effort can be utilized, wherein a dual function by way of a mechanical and electrical connection can also be partially achieved by means of the press-fit elements.

The printed circuit board can also feature a plurality of layers. To accomplish this, the at least one secondary winding can be formed as at least one layer of the circuit board. The circuit board can be designed merely by way of an example in particular with four layers comprising optional intermediate layers. Such an embodiment offers the advantage that the at least one secondary winding can be implemented in a space-utilizing manner.

The circuit board may furthermore feature at least one through-hole plating. In this case, the at least one through-hole plating can extend through all the layers of the circuit board. Such an embodiment offers the advantage that particularly buried through-hole platings within the circuit board can be omitted, and the cost for configurating of the printed circuit board can be reduced in this way.

Furthermore, the transformer apparatus may comprise at least one heat sink to dissipate heat from the circuit board and additionally or alternatively also from the insert element. To accomplish this, the circuit board can be arranged or is arranged between the at least one heat sink and the insert element. Such an embodiment provides the advantage that a heat dissipation or cooling of the transformer apparatus can be improved.

The transformer apparatus may hereby also feature a heat conducting layer to dissipate the heat from the circuit board to the at least one heat sink. To accomplish this, the heat conducting layer can be arranged or is arranged between the circuit board and the at least one heat sink. The heat conducting layer can be designed as a heat conducting foil on both sides. Such an embodiment provides the advantage that a heat dissipation as well as a heat transfer can be further improved.

A method for the manufacturing of a transformer apparatus is presented, wherein the method comprises a step of forming of an insert element, in which at least one primary winding of the transformer apparatus is arranged, a step of configuring a circuit board, in which at least one secondary winding of the transformer apparatus is arranged, and a step of a mutual coupling of the insert element, the circuit board and a transformer core.

By means of carrying out the method, an embodiment of the above-mentioned transformer apparatus can be manufactured in an advantageous manner. The step of forming and the step of configurating can hereby be carried out at the same time or at least partially in a sequential manner in any desired order. It is also possible that a partial assembly can be carried out at the transformer core in the step of forming and additionally or alternatively in the step of configurating.

According to one embodiment, at least one stranded wire can be embedded into an electrically insulating material in the step of forming. The electrically insulating material may refer to a plastic material. Such an embodiment provides the advantage, that the insert element can be implemented in a constructively simple and cost efficient manner.

Alternatively, another circuit board with the at least one secondary winding can be constructed in the step of forming. The further circuit board can be designed with multiple layers. To accomplish this, the at least one secondary winding can be formed as at least one layer of the additional circuit board. Such an embodiment offers the advantage that, in particular when there is a reduced current load at the at least one primary winding, the insert element can be implemented with at least one secondary winding that is configured in a planar manner.

A further apparatus is presented that is configured to carry out the steps of an embodiment of the before-mentioned method.

The apparatus may refer to an electrical device that processes electrical signals, such as e.g. sensor signals, and which sends out control signals in dependence of this. The apparatus may feature one or more suitable interfaces, which can be configured in a hardware and/or software manner. For a hardware configuration, the interfaces may e.g. be part of an integrated circuit, in which the functions of the apparatus are implemented. The interfaces may also refer to individual, integrated circuits or at least partially consist of discrete components. For a software configuration, the interfaces can be software modules, which are present on e.g. a microcontroller in addition to other software modules.

A computer program product with a program code that can be stored on a machine-readable carrier such as e.g. a semiconductor memory, a hard drive or an optical storage and which is used to carry out the method in accordance with one of the above-described embodiments when the program is executed on a computer or on a device is also advantageous.

Figure 2:
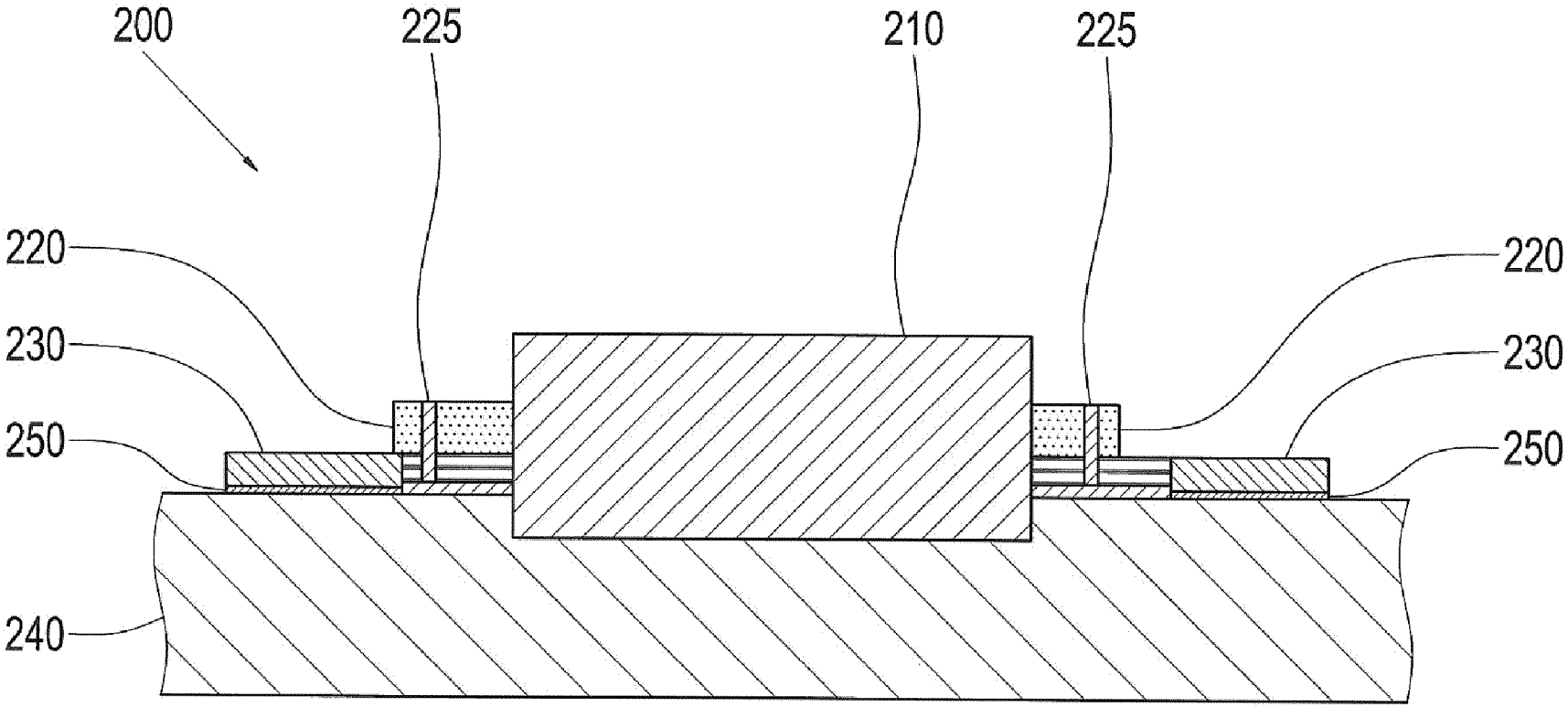
Figure 3:
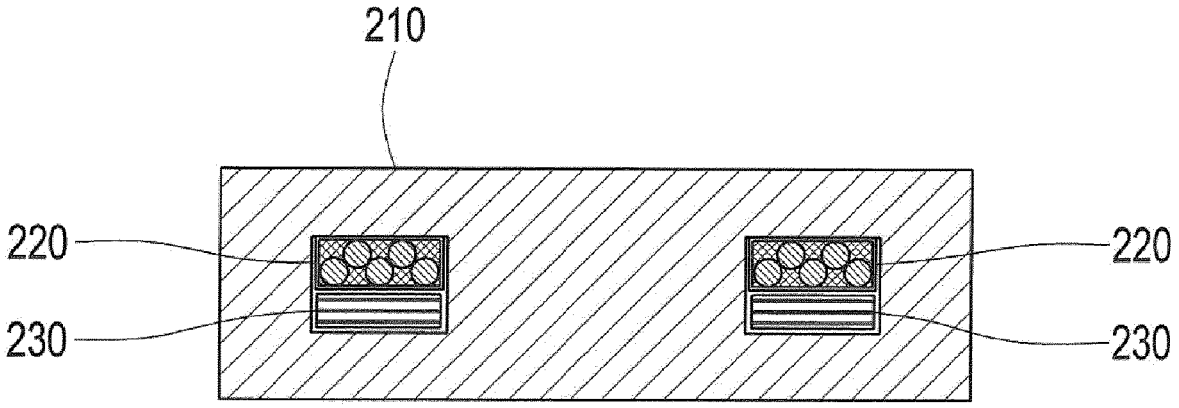
Figure 4:
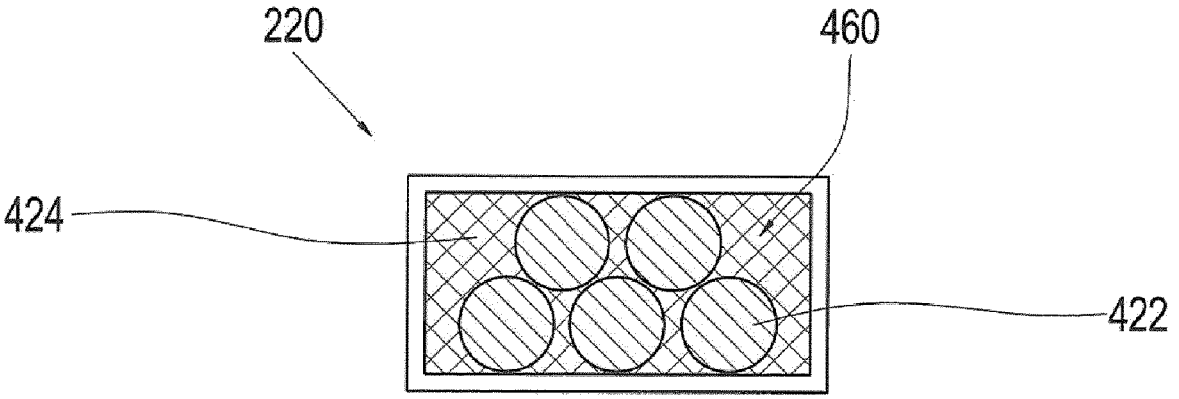
Figure 5:
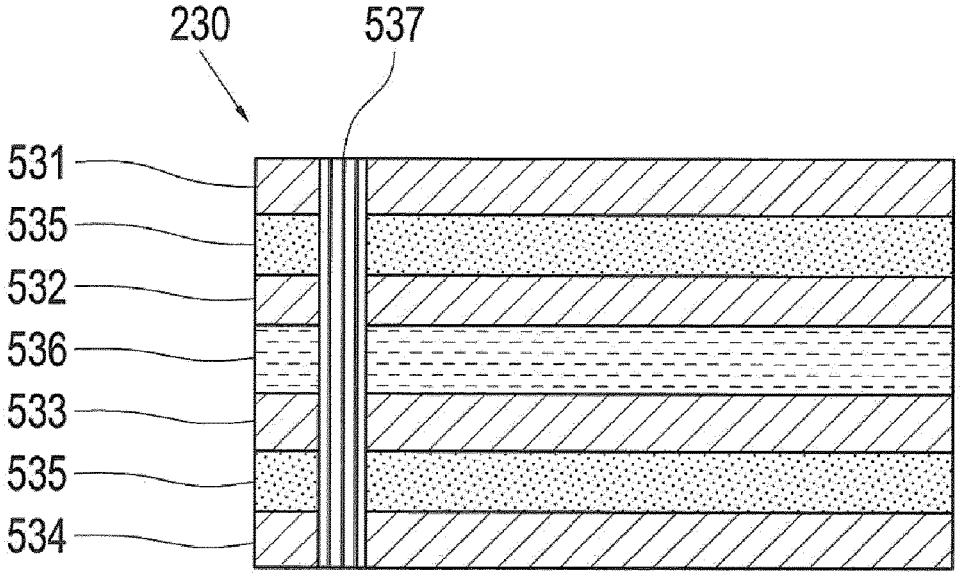
Figure 6:
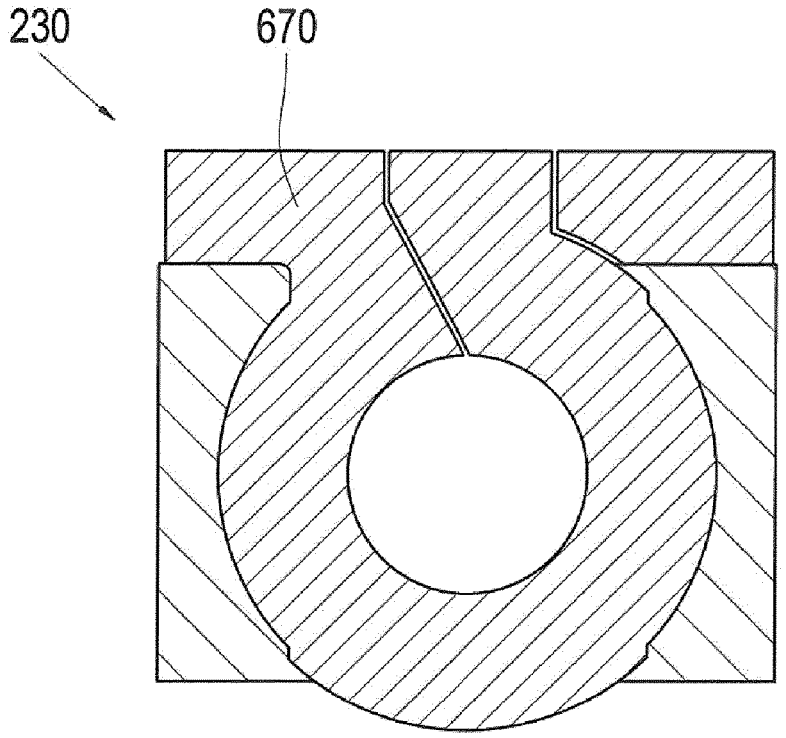
Figure 7:
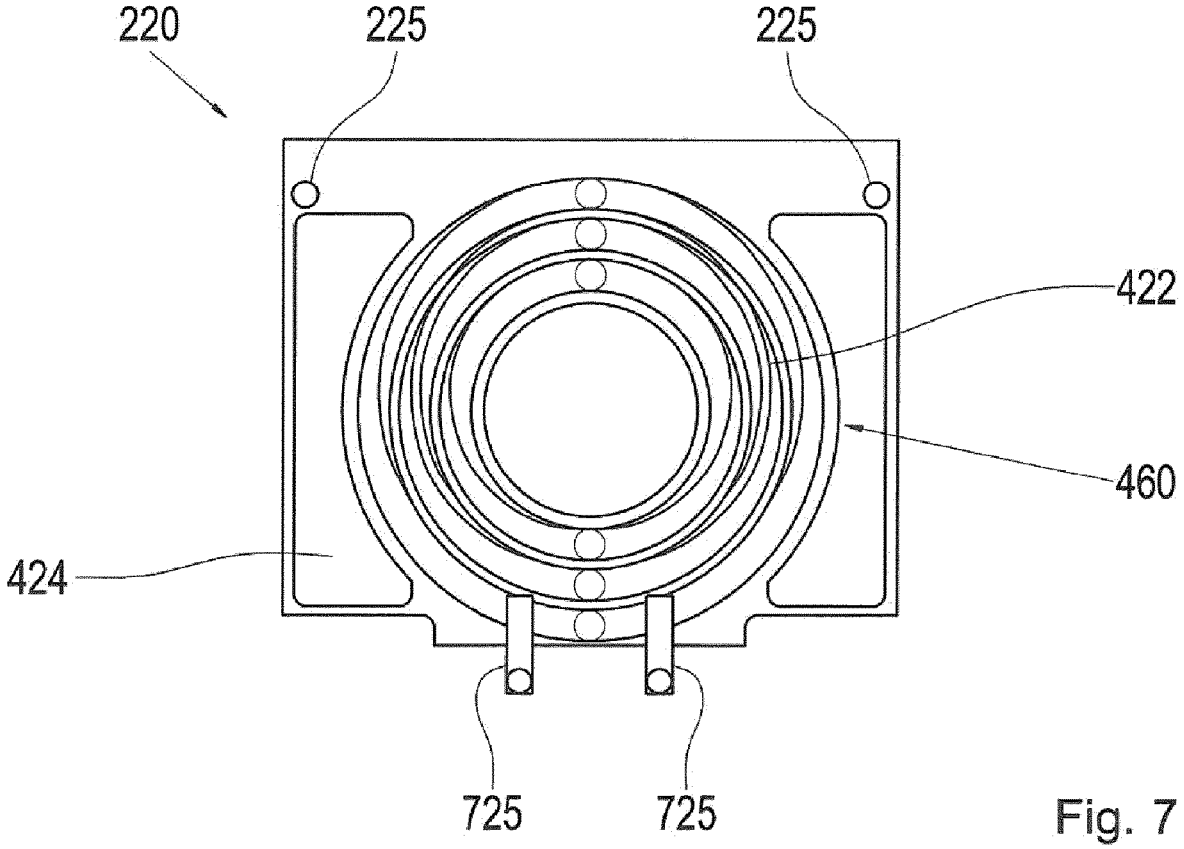
Figure 8:
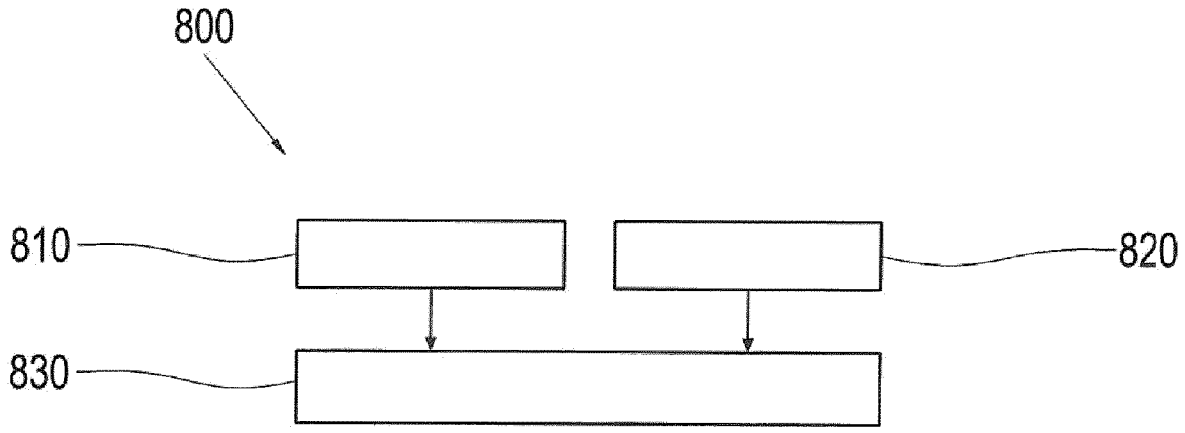
Figure 9:
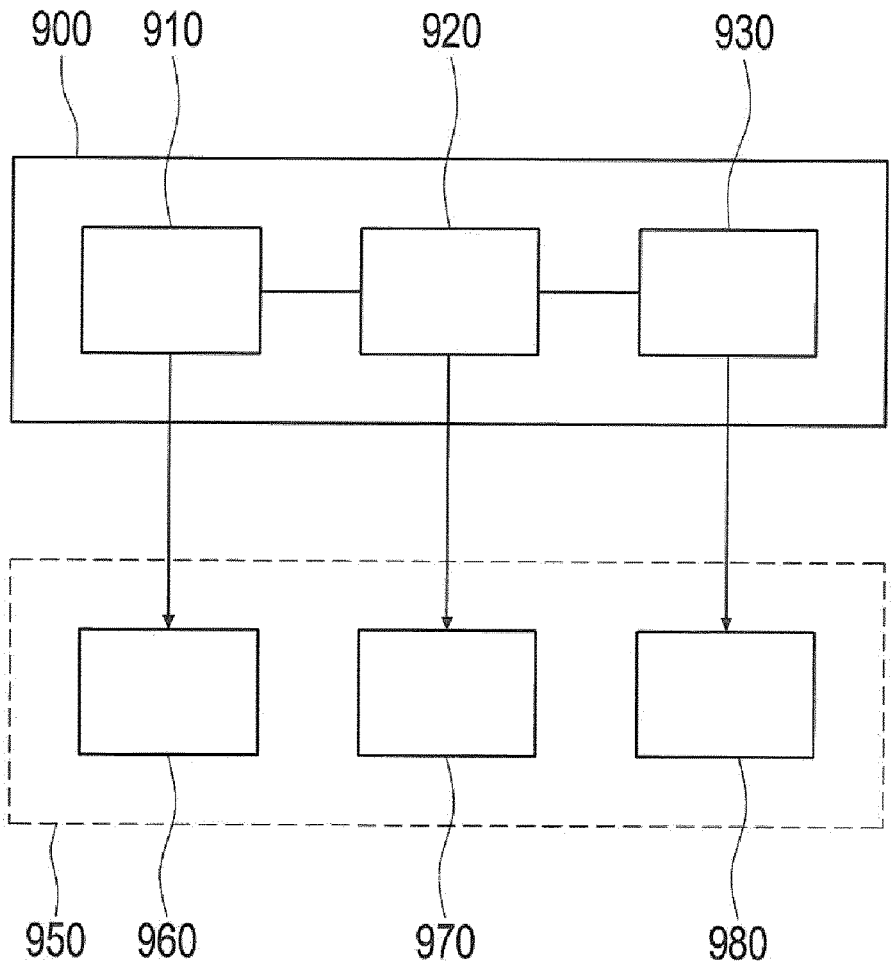

The invention will be explained in more detail by way of examples with reference to the attached drawings. The drawings show:

FIG. 1 a schematic sectional depiction of a planar transformer;

FIG. 2 a schematic sectional depiction of a transformer apparatus in accordance with one design example of the present invention;

FIG. 3 a schematic sectional depiction of a partial section of the transformer apparatus from FIG. 2;

FIG. 4 a schematic sectional depiction of the insert element of the transformer apparatus from FIG. 2;

FIG. 5 a schematic sectional depiction of the circuit board of the transformer apparatus from FIG. 2;

FIG. 6 a schematic depiction of the circuit board of the transformer apparatus from FIG. 2;

FIG. 7 a schematic depiction of the insert element of the transformer apparatus from FIG. 2;

FIG. 8 a flow chart of a method for the manufacturing in accordance with one design example of the present invention; and FIG. 9 a schematic depiction of an apparatus in accordance with one design example of the present invention.

In the following description of preferred design examples of the present invention, identical or similar reference signs are used for the elements that are depicted in the various figures and that function in a similar manner, wherein a repeated description of these elements will be omitted.

FIG. 1 depicts a schematic sectional depiction of a planar transformer 100. In other words, FIG. 1 depicts merely an 8-layer circuit board configuration of a planar transformer 100 by way of an example. In this example, the primary winding and the secondary winding of the planar transformer 100 are arranged within one single circuit board.

With reference to the depiction in FIG. 1, the circuit board configuration of the PCB comprises the following layer from top to bottom: a first layer 101, a semi-finished product layer 110 or prepreg layer 110 (prepreg=preimpregnated fibers), a second layer 102, a core layer 120, a third layer 103, another semi-finished layer 110, a fourth layer 104, another core layer 120, a fifth layer 105, a further semi-finished layer 110, a sixth layer 106, a further core layer 120, a seventh layer 107, a further semi-finished layer 110 and an eighth layer 108.

The second layer 102, the third layer 103, the sixth layer 106 and seventh layer 107 are hereby used for the primary winding, wherein the first layer 101, the fourth layer 104, the fifth layer 105 and the eighth layer 108 are used for the secondary winding.

The circuit board configuration of the circuit board furthermore features by way of an example only one through-hole plating 130 and it exemplifies only two buried through-hole platings 140 or so-called buried vias.

FIG. 2 depicts a schematic sectional depiction of a transformer apparatus 200 in accordance with one design example of the present invention. The transformer apparatus 200 comprises a transformer core 210 that is formed e.g. of ferrite. In addition to this, the transformer apparatus 200 comprises an insert element 220 in which at least one primary winding of the transformer apparatus 200 is arranged or formed. The transformer apparatus 200 also comprises a circuit board 230 in which at least one secondary winding of the transformer apparatus 200 is arranged or formed.

The insert element 220, the circuit board 230 and the transformer core 210 are mechanically coupled to each other. To accomplish this, the insert element 220 and the circuit board 230 are at least partially arranged within the transformer core 210. The insert element 220 and the circuit board 230 represent separate, mutually coupled assemblies or elements. In this way the at least one primary winding and the at least one secondary winding are arranged within separate elements. In other words, the at least one primary winding is implemented by means of the insert element 220 wherein the at least one secondary winding is implemented by means of the circuit board 230. The insert element 220 and the circuit board 230 will be dealt with in more detail in the following with reference to the following figures.

In accordance with the design example of the present invention that is depicted in FIG. 2, the insert element 220 comprises a plurality of press-fit elements 225, from which only two press-fit elements 225 are explicitly shown for a better representation. The press-fit elements 225 are formed in order to be pressed into the circuit board 230, in order to couple the insert element 220 with the circuit board 230. In the depiction of FIG. 2, the press-fit elements 225 are pressed into circuit board 230.

In accordance with the design example of the present invention as it is depicted in FIG. 2, the transformer apparatus 200 features by way of example a heatsink 240 for the dissipation of heat from the circuit board 230 and/or from the insert element 220. The circuit board 230 is hereby arranged between the heat sink 240 and the insert element 220. The heat sink 240 is at least coupled thermally with the circuit board 230. In addition to this, the transformer apparatus 200 hereby features a heat conducting layer 250 for the dissipation of heat from circuit board 230 to the heat sink 240. The heat conducting layer 250 is arranged between the circuit board 230 and the heat sink 240. The heat conducting layer 250 is hereby designed e.g. as heat conducting foil. The heat sink 240 is thus coupled thermally at least to the circuit board 230 via the heat conducting layer 250.

FIG. 3 depicts a schematic sectional depiction of a partial section of the transformer apparatus from FIG. 2. In the partial section that is depicted in FIG. 3, the transformer core 210, the insert element 220 and the circuit board 230 from the transformer apparatus are shown. The primary winding of the transformer apparatus is arranged within the insert element 220. The secondary winding of the transformer apparatus is arranged within the circuit board 230.

FIG. 4 depicts a schematic sectional depiction of the insert element 220 of the transformer apparatus from FIG. 2. The primary winding 460 is also explicitly shown. The primary winding 460 is implemented by using at least one stranded wire 422 or a high frequency stranded wire 422, which is embedded into an electrically insulating material 424 as an overmolding for electrical insulation. The electrically insulating material 424 refers to e.g. a plastic material. The insert element 220 thus comprises the stranded wire 422 or the high frequency stranded wire 422 and the electrically insulating material 424. The primary winding 460 is created by means of the stranded wire 422 or the high frequency stranded wire 422.

According to another design example, the insert element 220 can comprise another circuit board or be implemented as an additional circuit board, in which the primary winding is arranged.

FIG. 5 depicts a schematic sectional depiction of the circuit board 230 of the transformer apparatus from FIG. 2. The circuit board 230 exemplifies an 4-layer circuit board configuration of a planar transformer with a secondary winding and without a primary winding.

With reference to the depiction in FIG. 5, the circuit board configuration of the circuit board comprises the following layers from top to bottom: a first layer 531, a core layer 535, a second layer 532, a semi-finished product layer 536 or prepreg layer 536 (prepreg=preimpregnated fibers), a third layer 533, a further core layer 535 and a fourth layer 534. The circuit board 230 thus features a plurality of layers 531, 532, 533, 534, 535 and 536. The at least one secondary winding of the transformer apparatus is formed as at least one layer 531, 532, 533 and/or 534 of the circuit board.

The circuit board 230 furthermore exemplifies merely one through-hole plating 537. The through-hole plating 537 extends through-out all layers 531, 532, 533, 534, 535 and 536 of the circuit board 230.

FIG. 6 depicts a schematic depiction of the circuit board 230 of the transformer apparatus from FIG. 2. The circuit board 230 is hereby shown in a schematic top view or partially transparent top view. In FIG. 6, a secondary winding 670 is explicitly shown within the circuit board 230. Secondary winding 670 is formed or implemented as at least one layer, or in at least one layer of the circuit board 230.

FIG. 7 depicts a schematic depiction of the insert element 220 of the transformer apparatus from FIG. 2. The insert element 220 is hereby shown in a schematic top view or partially transparent top view. From the insert element 220, a plurality of press-fit elements 225 and 725, the stranded wire 422 or the high frequency stranded wire 422, the electrically insulating material 424 and the primary winding 460 are depicted in FIG. 7.

The primary winding 460 is hereby implemented in the insert element 220 by means of the high frequency stranded wire 422. The high-frequency stranded wire 422 is hereby wound several times. The high frequency stranded wire 422 is embedded or overmolded into the electrically insulating material 424.

The insert element 220 features a plurality of press-fit elements 225 and 725. More specifically, the insert element 220 comprises only by way of example four press-fit elements 225 and 725. Of these, the example shows that only two press-fit elements 225 are designed for fastening the insert element 220 or for press-fitting the insert element 220 into the circuit board of the transformer apparatus. By way of example, two other press-fit elements 725 of the plurality of press-fit elements 225 and 725 are designed as electrical connections for the primary winding 460 as well as for fastening the insert element 220 or for press-fitting the insert element 220 into the circuit board of the transformer apparatus. The press-fit elements 725 are thus used both to electrically contact the primary winding 460 as well as to mechanically fix the insert element 220. In other words, electrical connections for the primary winding 460 are thus connected or combined with two press-fit elements 725.

FIG. 8 depicts a flow chart of a method 800 for the manufacturing or a manufacturing method 800 in accordance with one design example of the present invention. The manufacturing method 800 can be carried out in order to produce a transformer apparatus. In more exact terms, manufacturing method 800 can be carried out to produce the transformer apparatus from FIG. 2 or a similar transformer apparatus.

The manufacture 800 comprises a step 810 of forming an insert element, in which at least one primary winding of the transformer apparatus is arranged. The manufacturing method 800 also comprises a step 820 of configurating a printed circuit board, in which at least one secondary winding of the transformer apparatus is arranged. The manufacturing method 800 furthermore includes a step 830 of coupling the insert element, the circuit board, and a transformer core together.

The step 810 of forming and the step 820 of configurating can be carried out in any desired order and additionally or alternatively at least partially at the same time.

According to one design example, at least one stranded wire can be embedded into an electrically insulating material in the step 810 of forming. Alternatively, another circuit board with the at least one secondary winding can be configured in the step 810 of forming.

FIG. 9 depicts a schematic depiction of an apparatus 900 in accordance with one design example of the present invention. Apparatus 900 is designed as a control unit. Apparatus 900 is configured to initiate or control the manufacturing of a transformer apparatus. More specifically, apparatus 900 is designed to initiate or control the manufacturing of the transformer apparatus from FIG. 2 or of a similar transformer apparatus.

Apparatus 900 is connected to a manufacturing system 950 in such a manner, that a transmitting of signals can be carried out. The manufacturing system 950 features by way of example only one first machine 960, one second machine 970 and one third machine 980.

Apparatus 900 comprises a forming device 910, which is designed to control the first machine 960 in order to form the insert element, in which at least one primary winding of the transformer apparatus is arranged. Apparatus 900 furthermore comprises a configuration device 920, which is designed to control the second machine 970 for the configurating of a circuit board, in which at least one secondary winding of the transformer apparatus is arranged. Furthermore, apparatus 900 comprises a coupling device 930, which is designed to control the third machine 970 for the mutual coupling of the insert element, the circuit board and a transformer core.

If a design example includes an "and/or" linking between a first characteristic and a second characteristic, this can be read in such a way that the design example according to one embodiment features both the first characteristic as well as the second characteristic and according to another embodiment either only the first characteristic or only the second characteristic.

LIST OF REFERENCE SIGNS

100 planar transformer
101 first layer
102 second layer
103 third layer
104 fourth layer
105 fifth layer
106 sixth layer
107 seventh layer
108 eighth layer
110 semi-finished layer or prepreg layer
120 core layer or core
130 through-hole plating
140 buried through-hole plating
200 transformer apparatus
210 transformer core
220 insert element
225 press-fit element
230 circuit board
240 heat sink
250 heat conducting layer
422 stranded wire
424 electrically insulating material
460 primary winding
531 first layer
532 second layer
533 third layer
534 fourth layer
535 core layer
536 semi-finished layer or prepreg layer
537 through-hole plating
670 secondary winding
725 press-fit element
800 method for manufacturing or manufacturing method
810 step of forming
820 step of configuring
830 step of mutual coupling
900 apparatus
910 forming device
920 configuring device
930 coupling device
950 manufacturing system
960 first machine
970 second machine
980 third machine

The invention claimed is:

1. A transformer apparatus comprising:
a transformer core;
at least one primary winding;
at least one secondary winding;
an insert element in which the at least one primary winding is arranged; and
a printed circuit board, in which the at least one secondary winding is arranged,
wherein the insert element, the circuit board and the transformer core are configured to be coupled with each other or are coupled with each other, and
wherein the insert element comprises at least one press-fit element configured to be press-fitted into the printed circuit board to couple the insert element to the printed circuit board.

2. The transformer apparatus according to claim 1, wherein the insert element comprises at least one stranded wire and an electrically insulating material, wherein the at least one stranded wire is embedded into the electrically insulating material.

3. The transformer apparatus according to claim 1, wherein the insert element comprises a second printed circuit board into which the at least one primary winding is arranged.

4. The transformer apparatus according to claim 1, wherein the insert element features a plurality of press-fit elements, wherein at least two press-fit elements of the plurality of press-fit elements comprise electrical connections for the primary winding.

5. The transformer apparatus according to claim 1, wherein the printed circuit board comprises a plurality of layers, wherein the at least one secondary winding corresponds to at least one layer of the circuit board.

6. The transformer apparatus according to claim 1, wherein the circuit board comprises at least one through-hole plating, wherein the at least one through-hole plating extends throughout all layers of the circuit board.

7. The transformer apparatus according to claim 1, further comprising: at least one heat sink for the dissipating heat from one or both of the printed circuit board and the insert element, wherein the printed circuit board is configured to be or is arranged between the at least one heat sink and the insert element.

8. The transformer apparatus according to claim 7, further comprising: a heat conducting layer for the dissipating heat from the printed circuit board to the at least one heat sink, wherein the heat conducting layer is configured to be or is arranged between the circuit board and the at least one heat sink.

9. The transformer apparatus according to claim 2, wherein the printed circuit board comprises a plurality of layers, wherein the at least one secondary winding corresponds to at least one layer of the circuit board.

10. The transformer apparatus according to claim 3, wherein the printed circuit board comprises a plurality of layers, wherein the at least one secondary winding corresponds to at least one layer of the circuit board.

11. The transformer apparatus according to claim 4, wherein the printed circuit board comprises a plurality of layers, wherein the at least one secondary winding corresponds to at least one layer of the circuit board.

* * * * *